US012507776B2

(12) United States Patent
Parker

(10) Patent No.: US 12,507,776 B2
(45) Date of Patent: Dec. 30, 2025

(54) LOCKABLE LUNCH BAG ASSEMBLY

(71) Applicant: Lawana Parker, Waukegan, IL (US)

(72) Inventor: Lawana Parker, Waukegan, IL (US)

( * ) Notice: Subject to any disclaimer, the term of this patent is extended or adjusted under 35 U.S.C. 154(b) by 560 days.

(21) Appl. No.: 17/675,831

(22) Filed: Feb. 18, 2022

(65) Prior Publication Data

US 2022/0167721 A1 Jun. 2, 2022

Related U.S. Application Data

(63) Continuation-in-part of application No. 16/823,654, filed on Mar. 19, 2020, now abandoned.

(51) Int. Cl.
*A45C 11/20* (2006.01)
*A45C 13/10* (2006.01)
*A45C 13/26* (2006.01)

(52) U.S. Cl.
CPC ..... *A45C 11/20* (2013.01); *A45C 13/10* (2013.01); *A45C 13/26* (2013.01)

(58) Field of Classification Search
CPC . A45C 11/20; B65D 81/3888; G07C 9/22174
USPC ..... 206/541; 150/101, 102
See application file for complete search history.

(56) References Cited

U.S. PATENT DOCUMENTS 2,289,254 A * 7/1942 Eagles ..... A45C 11/20 383/110
2,417,632 A * 3/1947 Clark ..... A45C 11/20 206/544
5,140,833 A 8/1992 Whalen
5,153,561 A 10/1992 Johnson
D364,320 S 11/1995 Sipe
5,472,279 A * 12/1995 Lin ..... A45C 11/20 383/110
2002/0084206 A1 7/2002 Protopapas
2002/0181806 A1* 12/2002 Godshaw ..... A45C 7/0063 383/110
2004/0035143 A1 2/2004 Mogil
2014/0319016 A1 10/2014 Glassman
2015/0335119 A1 11/2015 Baker
2020/0165861 A1* 5/2020 Bruno ..... E05B 65/52

FOREIGN PATENT DOCUMENTS

WO WO-2015101210 A1 * 7/2015 ..... B60R 25/209

* cited by examiner

*Primary Examiner* — Orlando E Aviles
*Assistant Examiner* — Sanjidul Islam

(57) ABSTRACT

A lockable lunch bag assembly for securing food in a lunch bag includes a lunch bag for retaining food stored therein at a desired temperature. The lunch bag has a flap thereon for opening or closing the lunch bag. An engagement is coupled to the lunch bag and a lock is coupled to the flap. The lock releasably engages the engagement when the flap is closed and the lock is positioned in a locking condition thereby inhibiting the flap from being opened. Conversely, the lock disengages the engagement when the lock is positioned in an unlocking condition thereby facilitating the flap to be opened. A strap is coupled to the lunch bag for carrying the lunch bag.

11 Claims, 7 Drawing Sheets

LOCKABLE LUNCH BAG ASSEMBLY

CROSS-REFERENCE TO RELATED APPLICATIONS

I hereby claim the benefit under 35 U.S.C., Section 120 of U.S. application Ser. No. 16/823,654 filed Mar. 19, 2020.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to lunch bag devices and more particularly pertains to a new lunch bag device for securing food in a lunch bag.

(2) Description of Related Art Including Information Disclosed Under 37 CFR 1.97 and 1.98

The prior art relates to lunch bag devices. The prior art discloses a bag with a zipper that can contain and conceal a lunch cooler. The prior art discloses an electronic lock box with an alphanumeric key pad. Additionally, the prior art discloses a modular lunch box that includes a plurality of stackable trays. The prior art discloses a variety of soft side coolers that do not have a means of being locked shut. The prior art also discloses a soft side cooler that has a flap for closure and a releasable clasp on the flap for securing the flap in a closed position.

BRIEF SUMMARY OF THE INVENTION

An embodiment of the disclosure meets the needs presented above by generally comprising a lunch bag for retaining food stored therein at a desired temperature. The lunch bag has a flap thereon for opening or closing the lunch bag. An engagement is coupled to the lunch bag and a lock is coupled to the flap. The lock releasably engages the engagement when the flap is closed and the lock is positioned in a locking condition thereby inhibiting the flap from being opened. Conversely, the lock disengages the engagement when the lock is positioned in an unlocking condition thereby facilitating the flap to be opened. A strap is coupled to the lunch bag for carrying the lunch bag.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
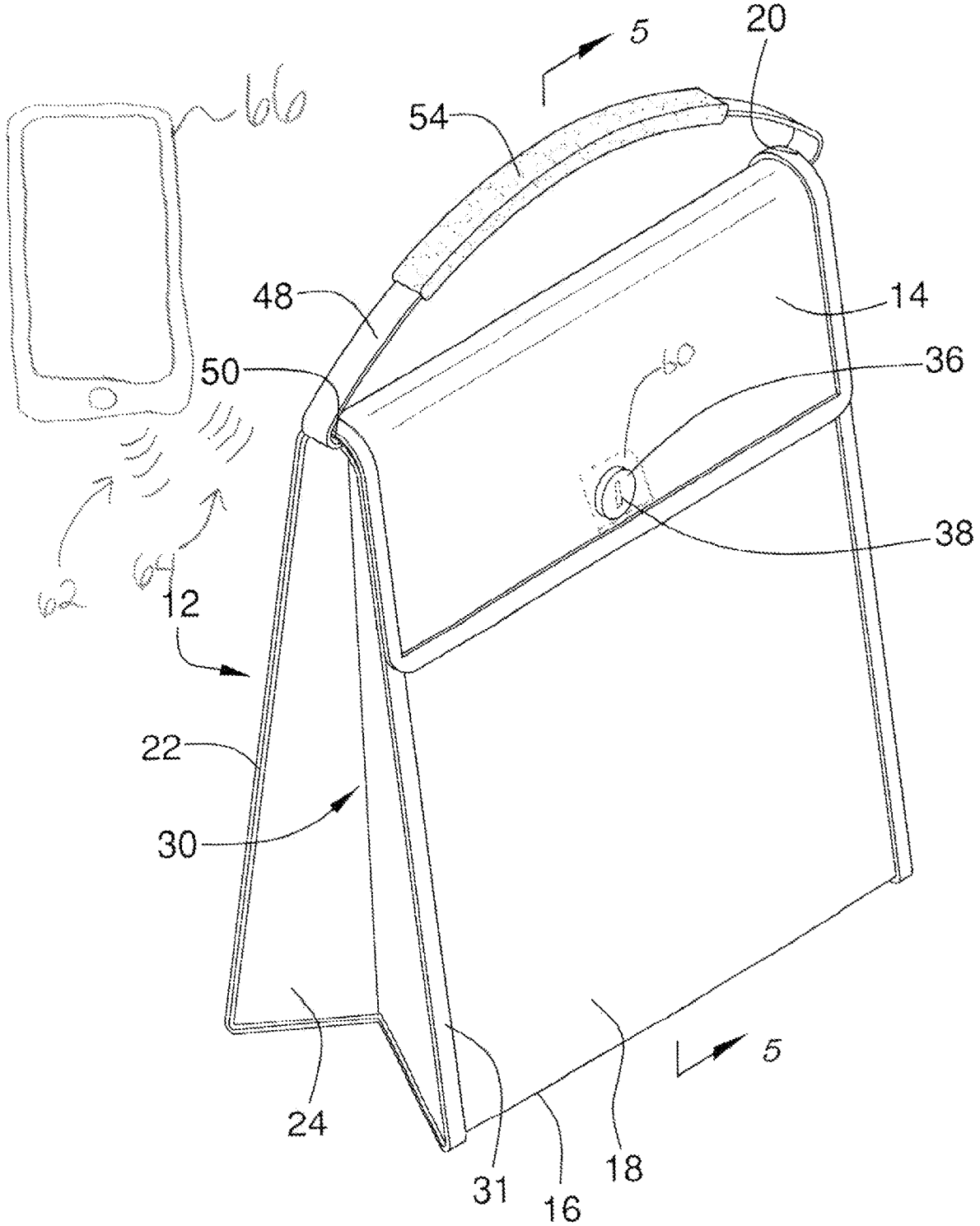
FIG. 1 is a front perspective view of a lockable lunch bag assembly according to an embodiment of the disclosure.
Figure 2:
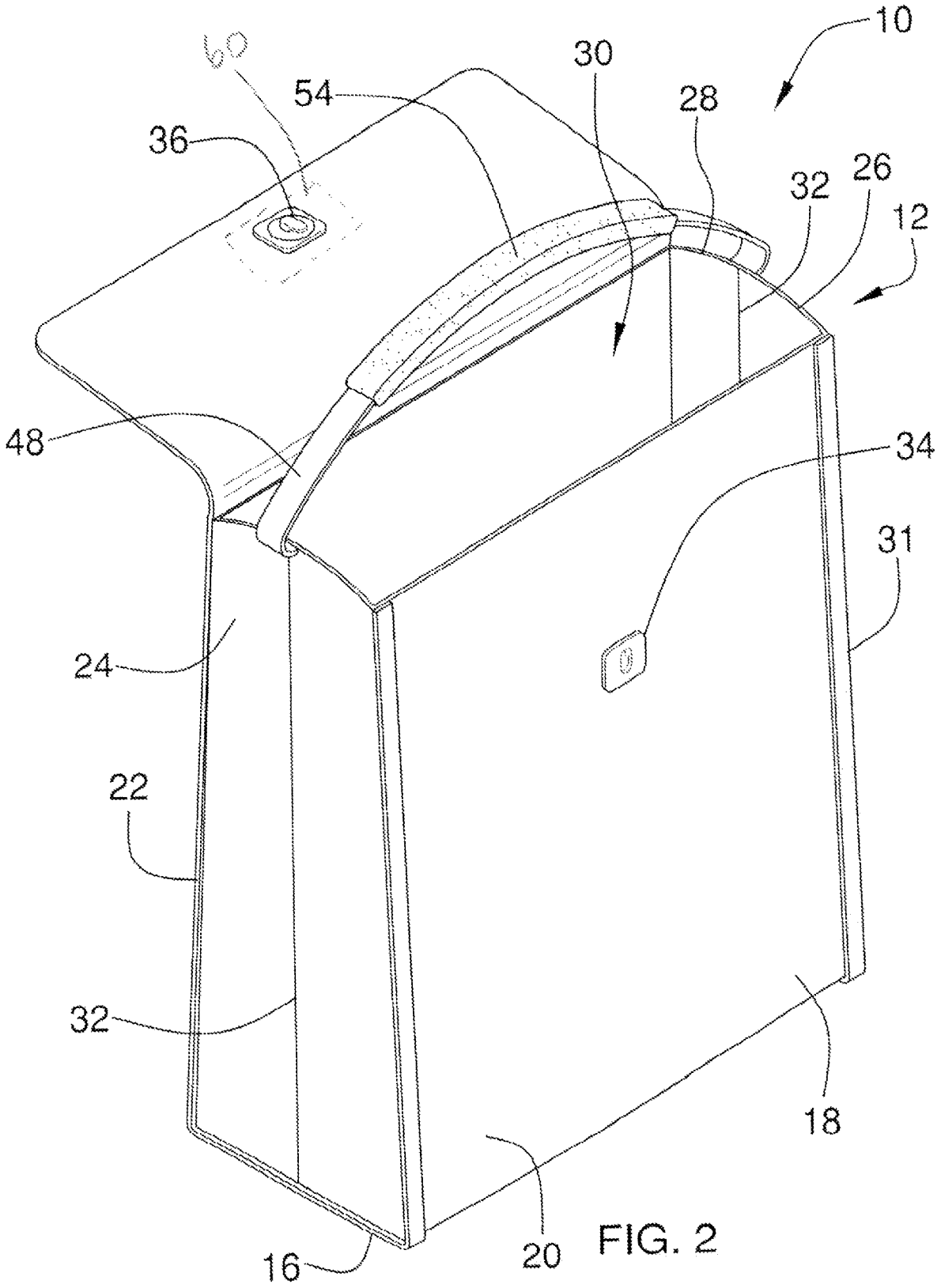
FIG. 2 is a top perspective view of an embodiment of the disclosure.
Figure 3:
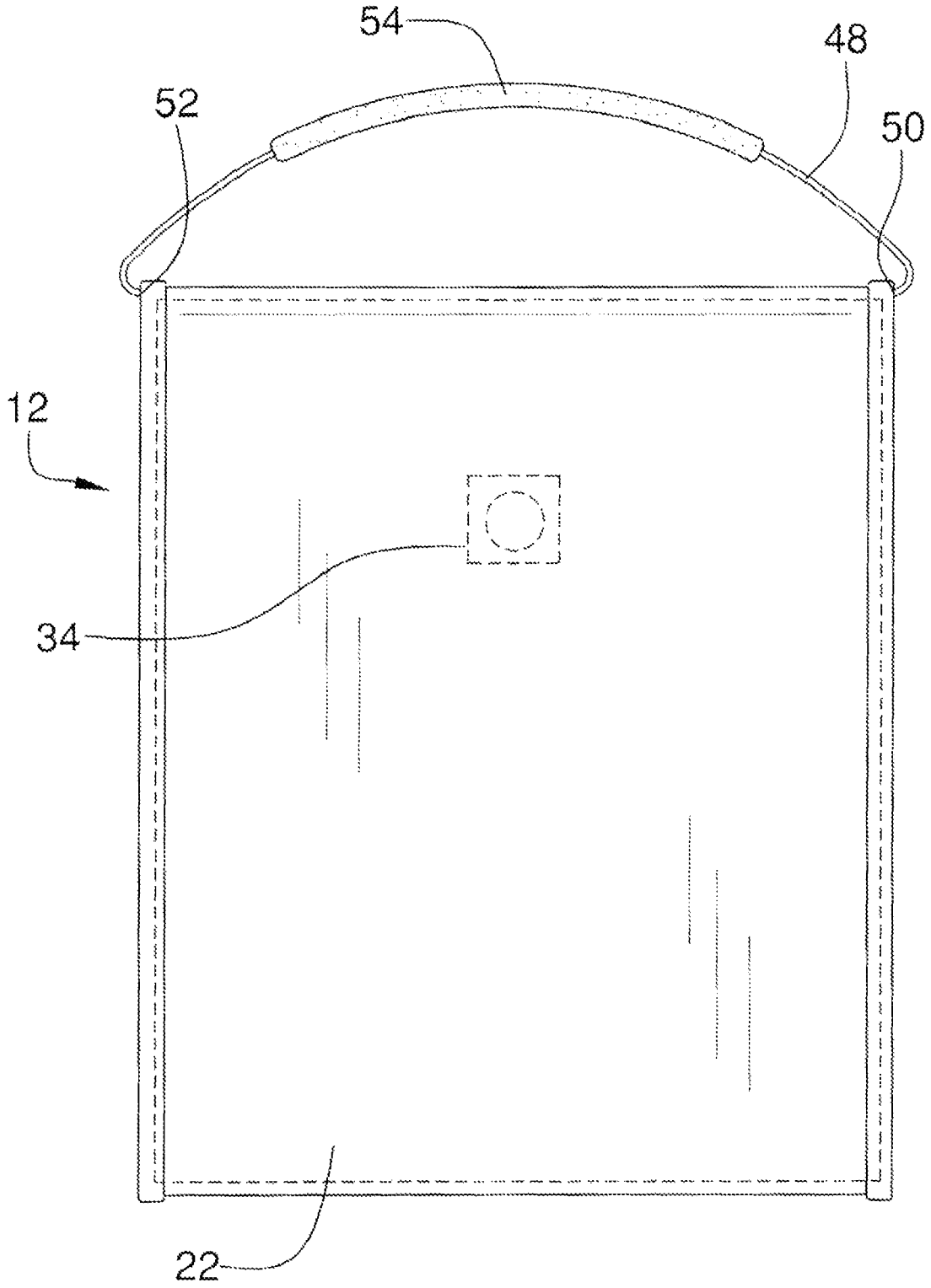
FIG. 3 is a back phantom view of an embodiment of the disclosure.
Figure 4:
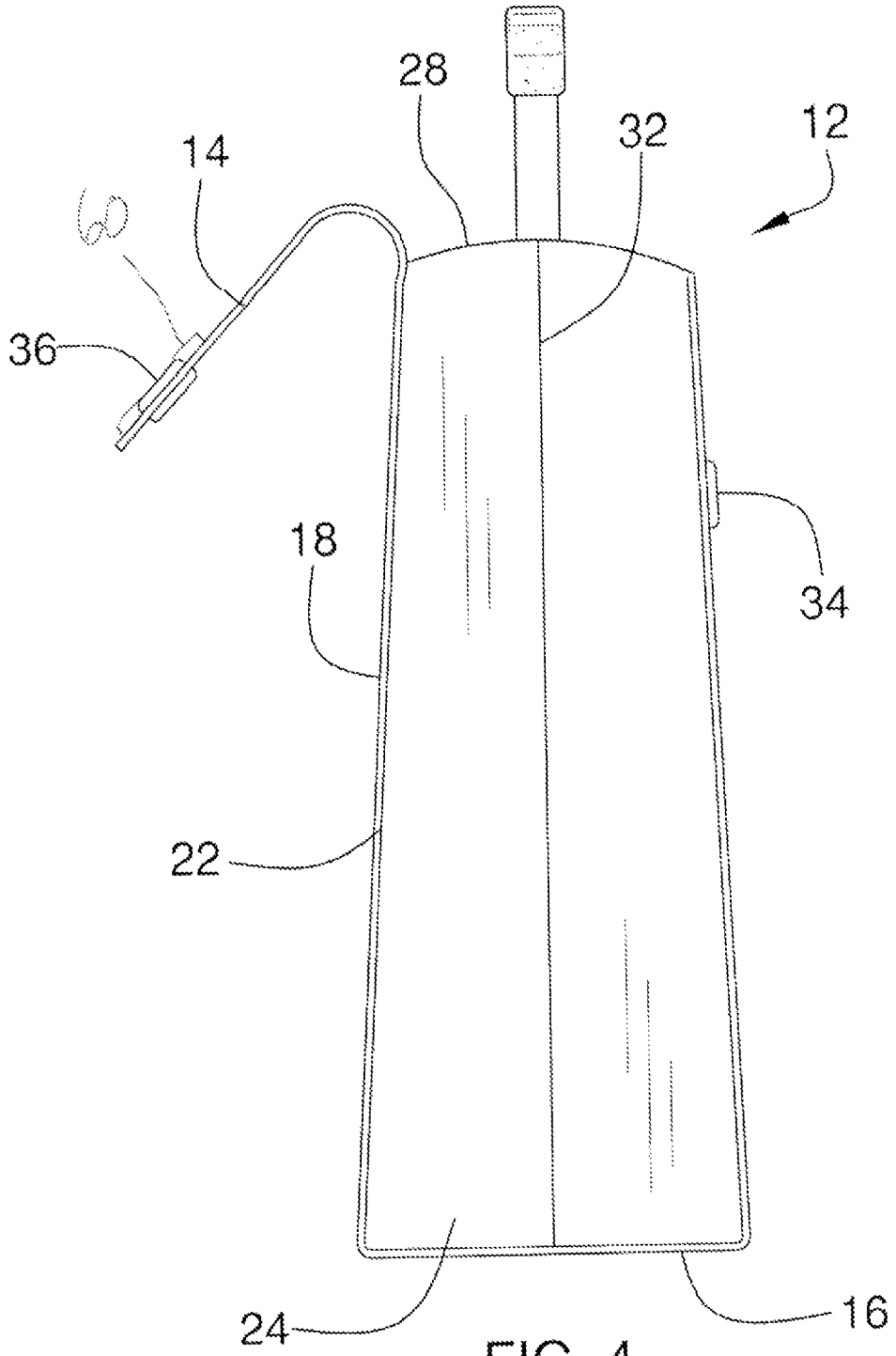
FIG. 4 is a right side view of an embodiment of the disclosure.
Figure 5:
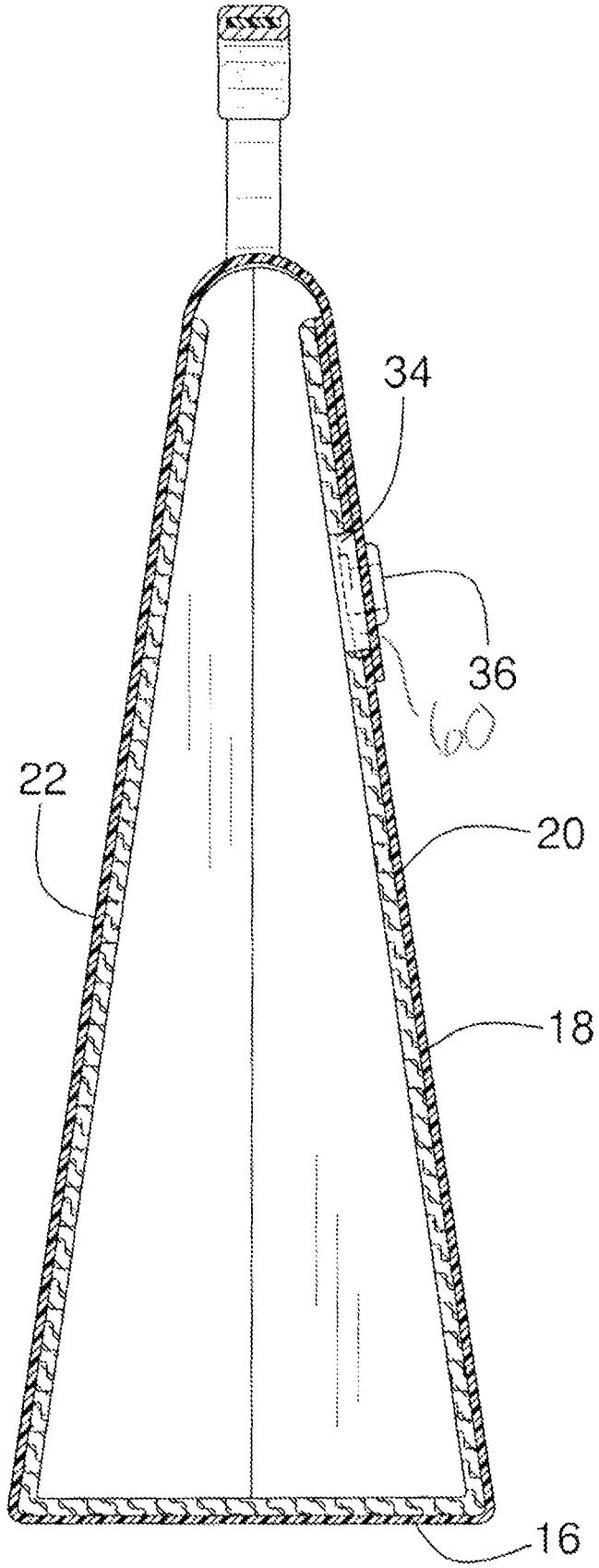
FIG. 5 is a cross sectional view taken along line 5-5 of FIG. 1 of an embodiment of the disclosure.

With reference now to the drawings, and in particular to FIGS. 1 through 7 thereof, a new lunch bag device embodying the principles and concepts of an embodiment of the disclosure and generally designated by the reference numeral 10 will be described.

As best illustrated in FIGS. 1 through 7, the lockable lunch bag assembly 10 generally comprises a lunch bag 12 that is comprised of a thermally insulating material to retain food items stored therein at a desired temperature. The lunch bag 12 is comprised of a deformable material thereby enhancing storage capacity of the lunch bag 12. Moreover, the lunch bag 12 has a flap 14 thereon for opening or closing the lunch bag 12.

The lunch bag 12 has a bottom wall 16 and a perimeter wall 18 extending upwardly therefrom, and the perimeter wall 18 has a front side 20, a back side 22, a first lateral side 24 and a second lateral side 26. The perimeter wall 18 has a distal edge 28 with respect to the bottom wall 16 to define an opening 30 into the lunch bag 12. Additionally, the back side 22 has a height that is greater than any of the first lateral side 24, the second lateral side 26 or the front side 20 to define the flap 14. The flap 14 is foldable onto the front side 20 for closing the opening 30. A border 31 is coupled to the lunch bag 12 and the border 31 extends around each of the first lateral side 24, the second lateral side 26 and the flap 14 for ornamental purposes.

Each of the first lateral side 24 and the second lateral side 26 has a fold 32 extending from the bottom wall 16 to the distal edge 28 of the perimeter wall 18. In this way each of the first lateral side 24 and the second lateral side 26 can be collapsed along the fold 32. Moreover, each of the first lateral side 24 and the second lateral side 26 tapers between the bottom wall 16 and the distal edge 28. Thus, the lunch bag 12 has a trapezoidal cross section taken along a line extending through the first lateral side 24 and the second lateral side 26.

An engagement 34 is coupled to the lunch bag 12 and the engagement 34 is positioned on the front side 20 of the perimeter wall 18 of the lunch bag 12. A lock 36 is coupled to the flap 14 and the lock 36 releasably engages the engagement 34 when the flap 14 is closed and the lock 36 is positioned in a locking condition. In this way the flap 14 is inhibited from is opened. Moreover, the lock 36 disengages the engagement 34 when the lock 36 is positioned in an unlocking condition thereby facilitating the flap 14 to be opened. The lock 36 has a key hole 38 therein for insertably receiving a key thereby facilitating the lock 36 to be moved between the locking condition and the unlocking condition.

A receiver 60 is coupled to the lunch bag 12. The receiver 60 is configured for receiving each of a lock signal 62 and an unlock signal 64 from an extrinsic electronic device 66 such as a cellular phone or the like. The receiver 60 is in operational engagement with the lock 36 such that the lock 36 is configured to be placed into the locking condition upon the receiver 60 receiving the lock signal 62 from the extrinsic electronic device 66 and the lock 36 is configured to be placed into the unlocking condition upon the receiver 60 receiving the unlock signal 64 from the extrinsic electronic device 66. The receiver 60 may be operationally engaged to the lock 36 through various alternative structures including but not limited to actuation of a ram to physically manipulate the lock 36, activation of a magnet, or rotation of a physical structure. The lock signal 62 and unlock signal 64 may be the communication of a code, password, or confirmation of the manipulation or pressing of a button within a program or application on the extrinsic electronic device 66. The communication may be through cellular service, internet connection, a wireless personal access network, near field technology, or the like.

Figure 6:
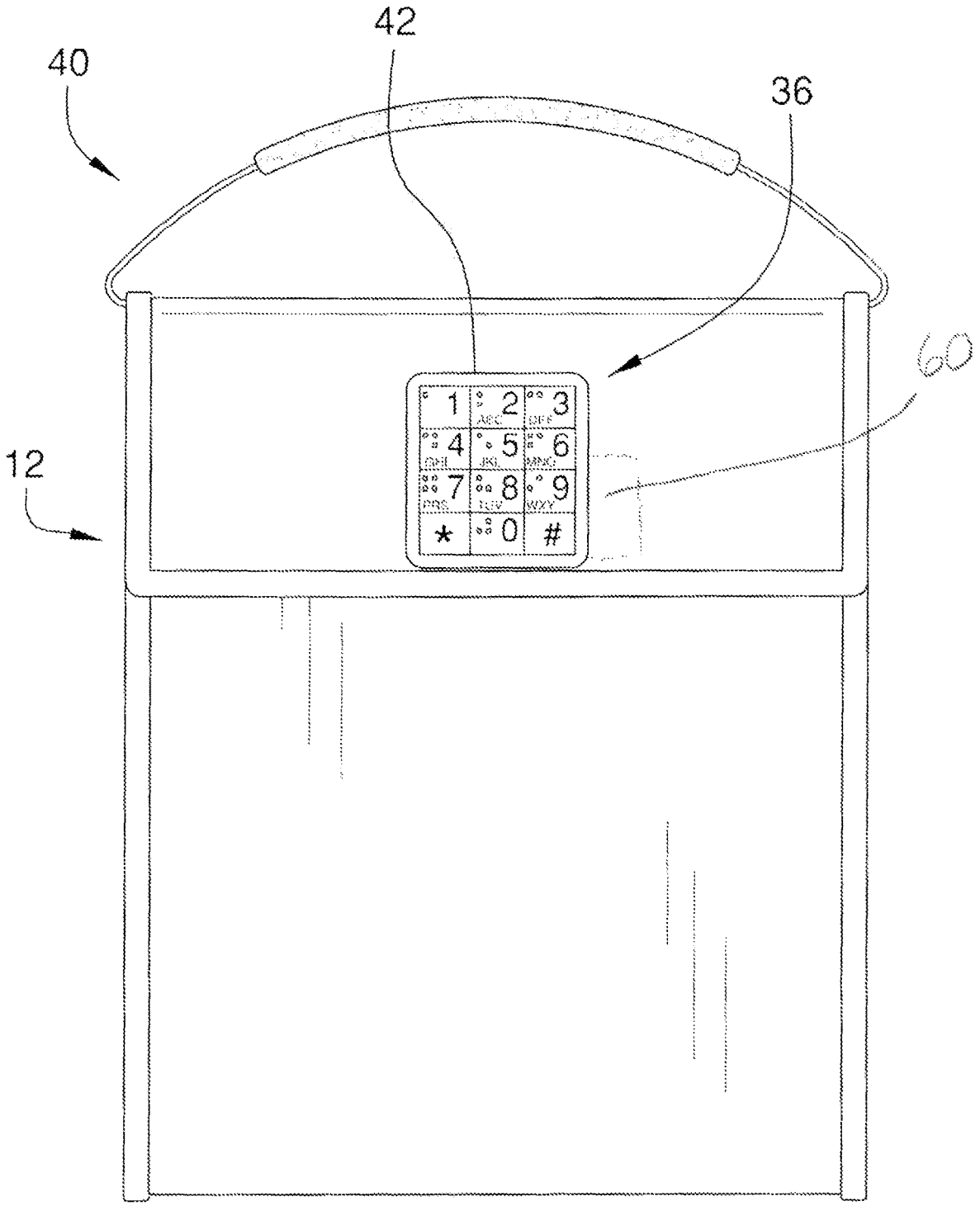
FIG. 6 is a front view of an embodiment of the disclosure.
Figure 7:
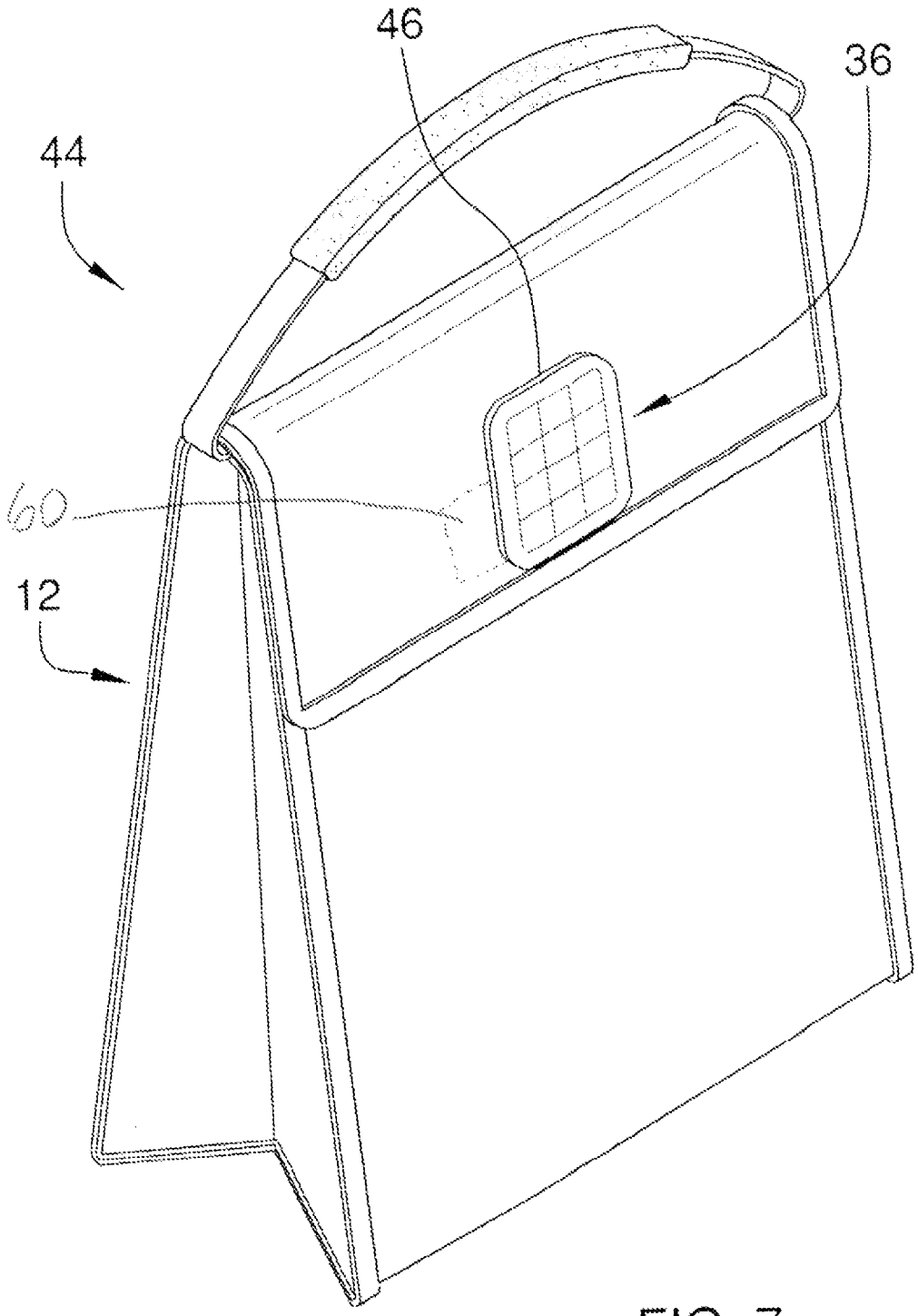
FIG. 7 is a front perspective view of an embodiment of the disclosure.

In an alternative embodiment 40 as is shown in FIG. 6, the lock 36 may comprise a keypad 42 that is positioned on the flap 14. The keypad 42 includes alphanumeric buttons for entering a pre-determined code into the keypad 42 and the keypad 42 includes a power supply. The keypad 42 disengages the engagement 34 when the pre-determined code is entered with the alphanumeric buttons. In alternative embodiment 44 as is most clearly shown in FIG. 7, the lock 36 may comprise a touch screen 46 that is positioned on the flap 14 and the touch screen 46 includes a power supply. The touch screen 46 is touched to enter a pre-determined alphanumeric code. The lock 36 disengages the engagement 34 when the pre-determined alphanumeric code is entered into the touch screen.

A strap 48 is coupled to the lunch bag 12 for carrying the lunch bag 12 and the strap 48 has a first end 50 and a second end 52. Each of the first end 50 and the second end 52 is coupled to the distal edge 28 corresponding to each of the first lateral side 24 and the second lateral side 26 of the perimeter wall 18 of the lunch bag 12. A cushion 54 is positioned around the strap 48 and the cushion 54 is comprised of a resiliently compressible material to enhance comfort when gripping the strap 48. The cushion 54 extends partially between the first end 50 and the second end 52 of the strap 48.

In use, food items are placed in the lunch bag 12 and the flap 14 is closed to facilitate the lock 36 to engage the engagement 34. In this way the food items in the lunch bag 12 are secured such that unauthorized users are inhibited from eating the food items. The lock 36 is unlocked to open the flap 14 and retrieve the food items to be eaten. In this way the lunch bag 12 ensures that only the owner of the lunch bag 12 can access the food items therein.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A lockable lunch bag assembly for inhibiting unauthorized users from accessing food contained therein, said assembly comprising:

a lunch bag being comprised of a thermally insulating material wherein said lunch bag is configured to retain food stored therein, said lunch bag being comprised of a deformable material thereby enhancing storage capacity of said lunch bag, said lunch bag having a flap thereon for opening or closing said lunch bag;

an engagement being coupled to said lunch bag;

a lock being coupled to said flap, said lock releasably engaging said engagement when said flap is closed and said lock is positioned in a locking condition thereby inhibiting said flap from being opened, said lock disengaging said engagement when said lock is positioned in an unlocking condition thereby facilitating said flap to be opened;

a receiver coupled to said lunch bag, said receiver being configured for receiving each of a lock signal and an unlock signal from an extrinsic electronic device, said receiver being in operational engagement with said lock such that said lock is configured to be placed into said locking condition upon said receiver receiving the lock signal from the extrinsic electronic device and said lock being configured to be placed into said unlocking condition upon said receiver receiving the unlock signal from the extrinsic electronic device; and a strap being coupled to said lunch bag for carrying said lunch bag.

2. The assembly according to claim 1, wherein said lunch bag has a bottom wall and a perimeter wall extending upwardly therefrom, said perimeter wall having a front side, a back side, a first lateral side and a second lateral side, said perimeter wall having a distal edge with respect to said bottom wall to define an opening into said lunch bag, said back side having a height being greater than any of said first lateral side, said second lateral side or said front side to define said flap, said flap being foldable onto said front side for closing said opening.

3. The assembly according to claim 2, wherein each of said first lateral side and said second lateral side has a fold extending from said bottom wall to said distal edge of said perimeter wall thereby facilitating each of said first lateral side and said second lateral side to collapsible along said fold.

4. The assembly according to claim 3, wherein each of said first lateral side and said second lateral side tapers between said bottom wall and said distal edge such that said lunch bag has a trapezoidal cross section taken along a line extending through said first lateral side and said second lateral side.

5. The assembly according to claim 2, wherein said engagement is positioned on said front side of said perimeter wall of said lunch bag.

6. The assembly according to claim 2, wherein said strap has a first end and a second end, each of said first end and said second end being coupled to said distal edge corresponding to each of said first lateral side and said second lateral side of said perimeter wall of said lunch bag.

7. The assembly according to claim 6, further comprising a cushion being positioned around said strap, said cushion being comprised of a resiliently compressible material wherein said cushion is configured to enhance comfort when gripping said strap, said cushion extending partially between said first end and said second end of said strap.

8. A lockable lunch bag assembly for inhibiting unauthorized users from accessing food contained therein, said assembly comprising:

a lunch bag being comprised of a thermally insulating material wherein said lunch bag is configured to retain food stored therein, said lunch bag being comprised of a deformable material thereby enhancing storage capacity of said lunch bag, said lunch bag having a flap thereon for opening or closing said lunch bag, said lunch bag having a bottom wall and a perimeter wall extending upwardly therefrom, said perimeter wall having a front side, a back side, a first lateral side and a second lateral side, said perimeter wall having a distal edge with respect to said bottom wall to define an opening into said lunch bag, said back side having a height being greater than any of said first lateral side, said second lateral side or said front side to define said flap, said flap being foldable onto said front side for closing said opening, each of said first lateral side and said second lateral side having a fold extending from said bottom wall to said distal edge of said perimeter wall thereby facilitating each of said first lateral side and said second lateral side to collapsible along said fold, each of said first lateral side and said second lateral side tapering between said bottom wall and said distal edge such that said lunch bag has a trapezoidal cross section taken along a line extending through said first lateral side and said second lateral side;

an engagement being coupled to said lunch bag, said engagement being positioned on said front side of said perimeter wall of said lunch bag;

a lock being coupled to said flap, said lock releasably engaging said engagement when said flap is closed and said lock is positioned in a locking condition thereby inhibiting said flap from being opened, said lock disengaging said engagement when said lock is positioned in an unlocking condition thereby facilitating said flap to be opened;

a receiver coupled to said lunch bag, said receiver being configured for receiving each of a lock signal and an unlock signal from an extrinsic electronic device, said receiver being in operational engagement with said lock such that said lock is configured to be placed into said locking condition upon said receiver receiving the lock signal from the extrinsic electronic device and said lock being configured to be placed into said unlocking condition upon said receiver receiving the unlock signal from the extrinsic electronic device;

a strap being coupled to said lunch bag for carrying said lunch bag, said strap having a first end and a second end, each of said first end and said second end being coupled to said distal edge corresponding to each of said first lateral side and said second lateral side of said perimeter wall of said lunch bag; and a cushion being positioned around said strap, said cushion being comprised of a resiliently compressible material wherein said cushion is configured to enhance comfort when gripping said strap, said cushion extending partially between said first end and said second end of said strap.

9. The assembly according to claim 8, wherein said lock comprises a keypad being positioned on said flap, said keypad including alphanumeric buttons for entering a pre-determined code into said keypad, said keypad disengaging said engagement when said pre-determined code is entered with said alphanumeric buttons.

10. The assembly according to claim 8, wherein said lock includes a touch screen being positioned on said flap wherein said touch screen is configured to be touched, said touch screen including a power supply, said touch screen being touched to enter a pre-determined alphanumeric code, said lock disengaging said engagement when said pre-determined alphanumeric code is entered into said touch screen.

11. The assembly according to claim 8, wherein said lock includes a key hole therein for insertably receiving a key thereby facilitating said lock to be moved between said locking condition and said unlocking condition.

* * * * *